US011364590B2

(12) United States Patent
Choi et al.

(10) Patent No.: US 11,364,590 B2
(45) Date of Patent: Jun. 21, 2022

(54) LINE CATCHER TYPE WATER JET CUTTING APPARATUS WITH PRODUCT FIXING PUSHER

(71) Applicant: TOPS CO., LTD., Gimhae-si (KR)

(72) Inventors: Chang Hoon Choi, Gimhae-si (KR); Tae Il Cho, Gimhae-si (KR); Min Soo Song, Gimhae-si (KR); Hyun Jung Kwon, Gimhae-si (KR); Jang Sung Kim, Gimhae-si (KR); Dong Jun Park, Gimhae-si (KR); Mohamed Ahmed Hashish, Bellevue, WA (US)

(73) Assignee: TOPS CO., LTD., Gimhae-si (KR)

( * ) Notice: Subject to any disclaimer, the term of this patent is extended or adjusted under 35 U.S.C. 154(b) by 209 days.

(21) Appl. No.: 16/822,763

(22) Filed: Mar. 18, 2020

(65) Prior Publication Data

US 2021/0129289 A1 May 6, 2021

(30) Foreign Application Priority Data

Nov. 6, 2019 (KR) ..... 10-2019-0140980

(51) Int. Cl.
*B24C 1/04* (2006.01)

(52) U.S. Cl.
CPC ..... *B24C 1/045* (2013.01)

(58) Field of Classification Search
CPC .. B24C 1/04; B24C 1/045; B24C 3/06; B24C 3/065; B24C 3/083; B24C 3/085; B24C 3/12; B26F 3/004
USPC ..... 451/2, 10, 11, 38, 81, 90, 91, 336, 365, 451/403; 83/447
See application file for complete search history.

(56) References Cited

U.S. PATENT DOCUMENTS 4,469,318 A * 9/1984 Slavic ..... B23Q 3/002 144/250.15
5,003,729 A * 4/1991 Sherby ..... B23Q 11/0032 451/365

FOREIGN PATENT DOCUMENTS

JP 01146700 A * 6/1989
JP H01-146700 A 6/1989
JP H03-178800 A 8/1991
JP H05-245758 A 9/1993
JP 2019-171527 A 10/2019
JP 2019171527 A * 10/2019

OTHER PUBLICATIONS

JP-01146700-A translation (Year: 1989).*
JP-2019171527-A Translation (Year: 2019).*

* cited by examiner

*Primary Examiner* — Monica S Carter
*Assistant Examiner* — Abbie E Quann
(74) *Attorney, Agent, or Firm* — Paratus Law Group, PLLC

(57) ABSTRACT

Disclosed is a line catcher type water jet cutting apparatus. Portions of a workpiece to be converted into products are processed by water jet cutting in a common manner in an early stage of the water jet cutting. In a final stage of the water jet cutting, product fixing pushers press and fix the workpiece.

5 Claims, 9 Drawing Sheets

LINE CATCHER TYPE WATER JET CUTTING APPARATUS WITH PRODUCT FIXING PUSHER

CROSS REFERENCE TO RELATED APPLICATION

The present application claims priority to Korean Patent Application No. 10-2019-0140980, filed on Nov. 6, 2019, which is hereby incorporated by reference in its entirety.

BACKGROUND

The present invention relates generally to a line catcher type water jet cutting apparatus and, more particularly, to a line catcher type water jet cutting apparatus including product fixing pushers to fix a workpiece by pressing a top surface of a portion of the workpiece to be converted into the product.

Generally, waterjet cutting is a processing method of cutting a workpiece by ejecting pressurized water or a pressurized mixture of water and an abrasive onto a workpiece.

Waterjet processing has the advantages in that heat is not generated during processing so that a workpiece is not thermally deformed, that few burrs remain after the completion of the process, and that it is applicable to any kind of workpiece material.

Waterjet cutting may be applied to a workpiece, such as corrugated board, disposable diapers, sand paper, rubber products, urethane products, tires, leather products (natural and synthetic), textiles, nylon, vinyl, other plastics, FRP, Kevlar, printed boards, other composite materials, glass, fiber glass, ceramic, wood, plywood, asbestos, gypsum board, tile, other building materials, concrete, cement, asphalt, iron, nonferrous metals, stainless steel, other special metals, frozen meat, etc.

In the meantime, a conventional line catcher-type waterjet cutting apparatus including a carry-in belt-type conveyor unit loading and reciprocally conveying a plate-type workpiece in an X-direction, a carry-out belt-type conveyor unit disposed on a rear side of the carry-in belt-type conveyor unit, with a processing interval extending in a y-direction, to load and reciprocally convey the workpiece in the X-direction, an ejection nozzle disposed above the processing spacing to eject a pressurized fluid onto the workpiece for processing the workpiece, an ejection nozzle driver unit driving the ejection nozzle to reciprocally move in the y-direction, and a catcher disposed below the ejection nozzle to receive the pressurized fluid ejected from the ejection nozzle has been known.

A conventional technique related to a line catcher-type waterjet cutting apparatus has been disclosed in Japanese Patent Application Publication No. H 03-178800 (published on Aug. 2, 1991), Japanese Patent Application Publication No. H 01-146700 (published on Jun. 8, 1989).

Problems of such a line catcher type water jet cutter will be described with reference to FIG. 14.

FIG. 14 is a plan view illustrating a cutting state of a workpiece in order to describe problems of the related art.

To cut a workpiece 10 into a product 11, a water jet nozzle must move along a single closed curve.

Then, the workpiece 10 is divided into the product 11 and a remaining portion 12 surrounding the product 11 by water jet cutting.

Typically, the workpiece 10 is loaded on a carry-in belt-type conveyor unit and a carry-out belt-type conveyor unit and the position of the workpiece 10 is fixed to the carry-in belt-type conveyor unit and the carry-out belt-type conveyor unit due to the weight of the workpiece 10. Thus, before a final stage of the cutting of the workpiece (including an early stage of the cutting of the workpiece), there may be substantially no problems related to changes in the position of the workpiece.

However, at a moment that a closed curve for the product 11 is completed in the workpiece 10 by the water jet cutting (e.g. the final stage of the cutting of the workpiece, i.e. a moment that a start point of the cutting meets an end point of the cutting), a portion of the workpiece 10 to be converted into the product 11 may be torn from the workpiece 10 while the position thereof is changed by a pressurized fluid striking the workpiece 10. Accordingly, such a change in the position of the product 11 may cause a danger that a portion of the product 11 to be finally cut is not cut in an intended shape. That is, the possibility of defective cutting may be increased.

Substantially no such problems may occur in a case in that the workpiece 10 is made of a material, such as metal, having a relatively-large mass and a relatively-high degree of surface frictional force. However, in a case in that the workpiece 10 is made of a material, such as food, plastic, or glass, having a relatively-small mass and relatively-low degree of surface frictional force, the possibility of defective cutting may be further increased.

In particular, in the line catcher type water jet cutter designed to cut the workpiece 10 while reciprocally moving the workpiece 10 in an X direction, the danger of defective cutting as described above may further be increased.

According to the above-described problem, the market competitiveness of the line catcher type water jet cutter is further reduced as the importance of processing precision in water jet cutting is increasing.

The foregoing is intended merely to aid in the understanding of the background of the present invention, and is not intended to mean that the present invention falls within the purview of the related art that is already known to those skilled in the art.

SUMMARY

Accordingly, the present invention has been made keeping in mind the above problems occurring in the related art, and the present invention proposes a line catcher type water jet cutting apparatus in which portions of a workpiece to be converted into products are processed by water jet cutting in a common manner in an early stage of the water jet cutting and, in a final stage of the water jet cutting, product fixing pushers press and fix the workpiece, so that more precise products can be obtained.

In order to achieve the above objective, according to one aspect of the present invention, there is provided a line catcher type water jet cutting apparatus for cutting a workpiece to divide the workpiece into a product and a remaining portion surrounding the product. The line catcher type water jet cutting apparatus may include: a carry-in belt-type conveyor unit configured to transport a plate-shaped workpiece loaded thereon reciprocally in an X direction; a carry-out belt-type conveyor unit configured to transport the workpiece loaded thereon reciprocally in the X direction, and disposed adjacent to and spaced apart from a rear end of the carry-in belt-type conveyor unit with a processing interval extending in a Y-direction; an ejection nozzle disposed above the processing interval to eject a pressurized fluid to cut the workpiece; a nozzle driving unit driving the ejection nozzle to move reciprocally in a Y direction; a catcher provided below the ejection nozzle to receive the pressurized fluid ejected from the ejection nozzle; a product fixing pusher fixing the workpiece by pressing a top surface of a portion of the workpiece to be converted into the product; a pusher frame to which the product fixing pusher is coupled; and a pusher driving unit driving the pusher frame to move in a top-bottom direction, wherein, in an early stage of cutting of the workpiece, the pusher driving unit moves the pusher frame upwards so that the product fixing pusher is spaced apart from the workpiece so that the portion of the workpiece to be converted into the product is not pressed by the product fixing pusher, and in a final stage of the cutting of the workpiece, the pusher driving unit moves the pusher frame downwards so that the product fixing pusher presses and fixes the portion of the workpiece to be converted into the product.

The product fixing pusher may comprise a plurality of product fixing pushers, and the pusher frame may include a single head frame coupled to the pusher driving unit and a plurality of branch frames provided between the head frame and the product fixing pushers, the branch frames being spaced apart from each other in the Y direction.

The product fixing pusher may comprise a ball or a roller coming into contact with the workpiece moving in the X direction to rotate in concert with the movement of the workpiece, and the pusher frame may rotatably supports the product fixing pusher.

The pusher frame may include a connecting frame movable in the top-bottom direction by the pusher driving unit and an elastic support frame coupled to the connecting frame via an elastic member to rotatably support the product fixing pusher, the elastic support frame being movable in the top-bottom direction while elastically supported by the elastic member depending on degrees of flatness of the workpiece.

The line catcher type water jet cutting apparatus may comprises a workpiece edge clamping device to clamp edges of the workpiece to be converted into the remaining portion while being moved reciprocally in the X direction in concert with the carry-in belt-type conveyor unit.

According to the present invention, portions of a workpiece to be converted into products are processed by water jet cutting in a typical manner (i.e. in a condition in which the product fixing pushers are not operated) in an early stage of the water jet cutting and, in a final stage of the water jet cutting, the product fixing pushers press and fix the workpiece, so that more precise products can be obtained.

Accordingly, the present invention can reliably solve the problem of defective cutting of the products due to changes in the position of the products.

BRIEF DESCRIPTION OF THE DRAWINGS

The above and other objectives, features, and other advantages of the present invention will be more clearly understood from the following detailed description when taken in conjunction with the accompanying drawings, in which.

DETAILED DESCRIPTION

Figure 1:
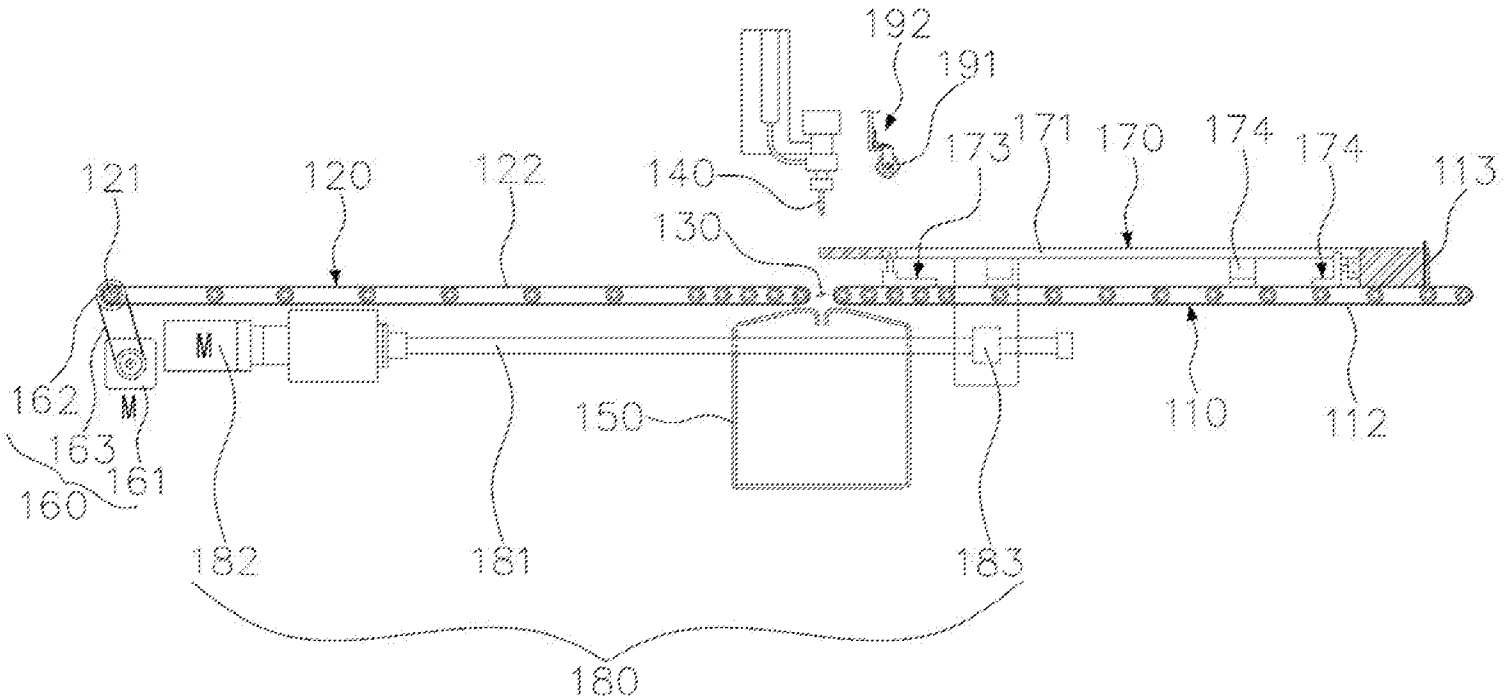
FIG. 1 is a conceptual view illustrating a water jet cutting apparatus according to an embodiment of the present invention.

Hereinbelow, exemplary embodiments of the present invention will be described in detail with reference to the accompanying drawings to allow those skilled in the art to easily implement the embodiments. However, the present invention is not limited to those embodiments, but may be implemented into other forms. In the drawings, parts irrelevant to the description are omitted for simplicity of explanation, and like reference numerals designate like parts throughout the specification.

Throughout the specification, the expression describing that an element "includes" a component means that the element may further include other configurations unless the context clearly indicates otherwise.

Figure 2:
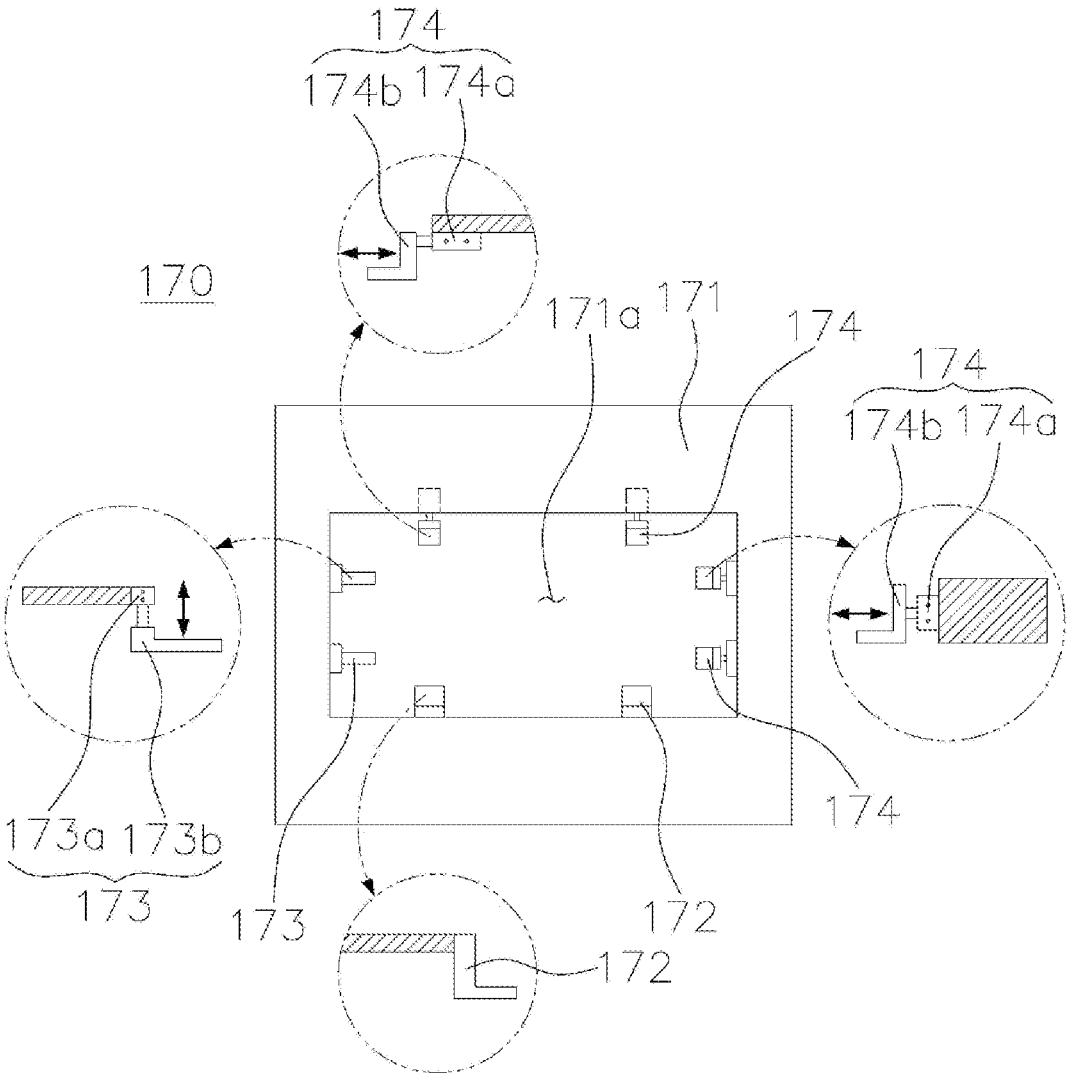
FIG. 2 is a plan view of the workpiece edge clamping device illustrated in FIG. 1 and conceptual side views of portions of the workpiece edge clamping device.
Figure 3:
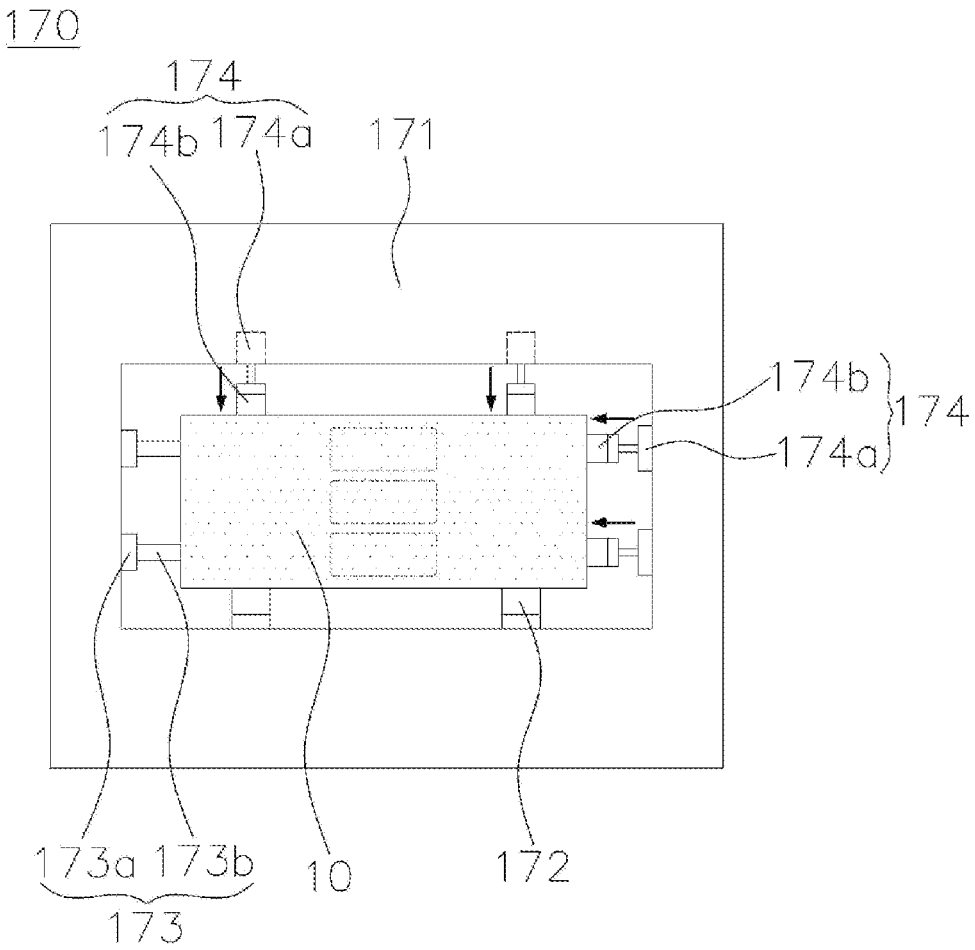
FIG. 3 is a plan view of the workpiece edge clamping device illustrated in FIG. 2, in which a workpiece is loaded.
Figure 4:
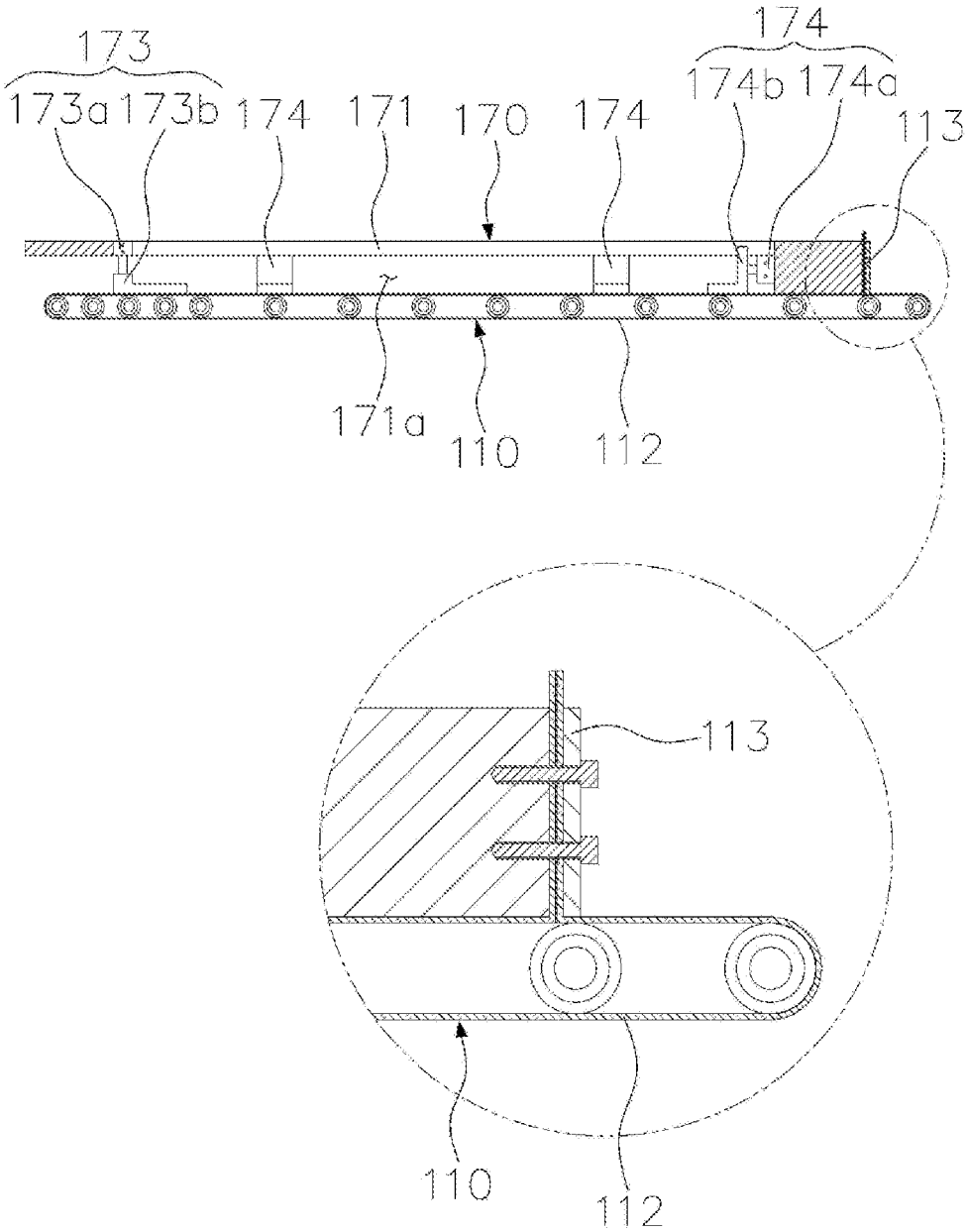
FIG. 4 is an enlarged view of the workpiece edge clamping device and the carry-in belt-type conveyor unit illustrated in FIG. 1.
Figure 5:
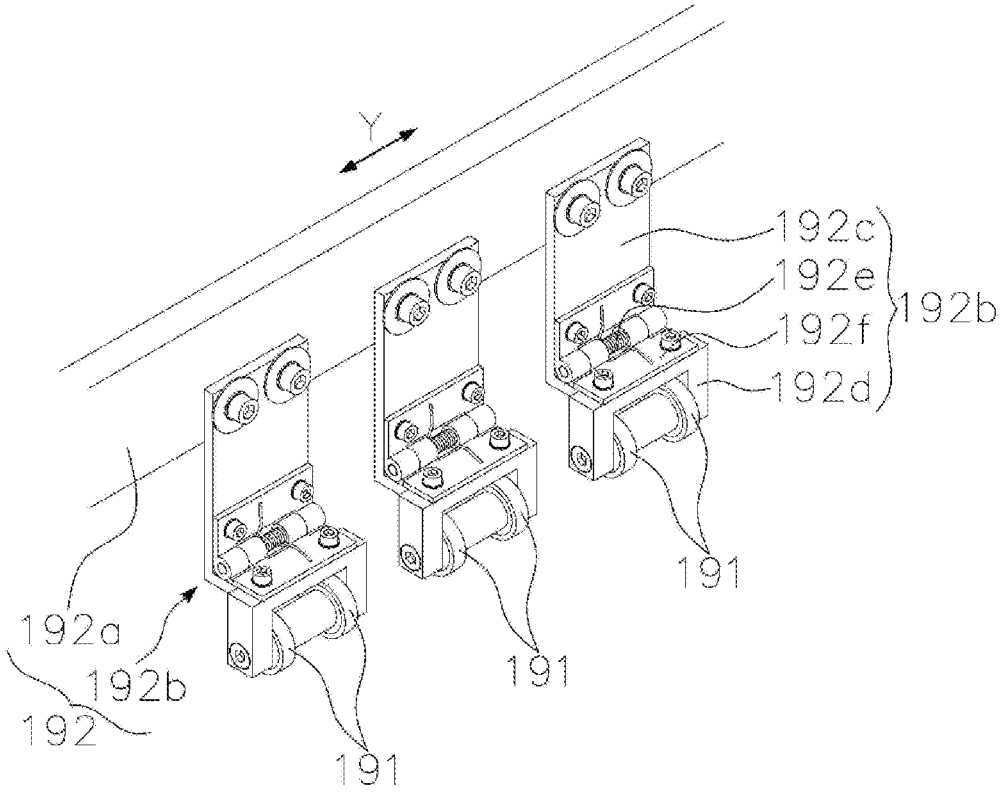
FIG. 5 is a perspective view of the product fixing pushers and the pusher frame illustrated in FIG. 1.
Figure 6:
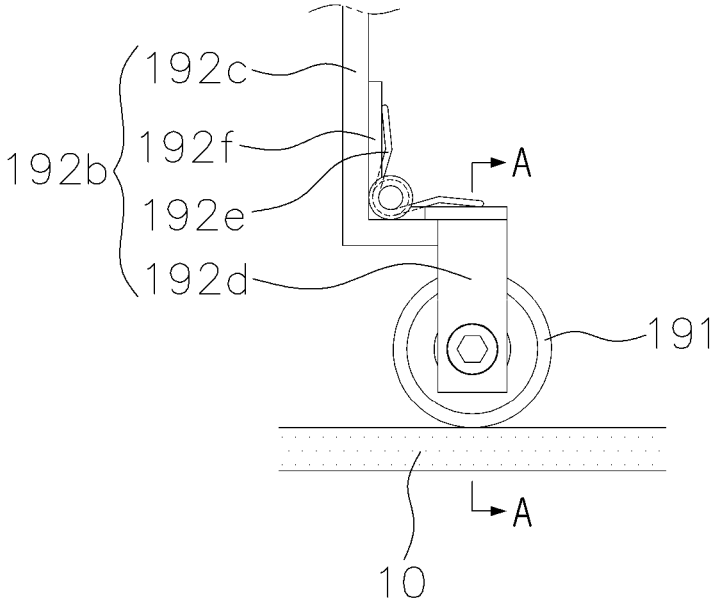
FIG. 6 and FIG. 7 are conceptual side views of operating states of the pusher frame illustrated in FIG. 5.
Figure 7:
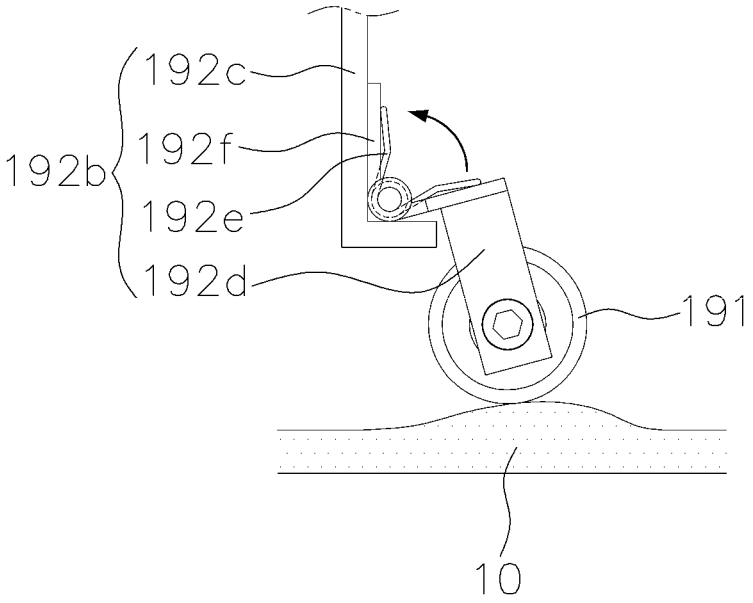
Figure 8:
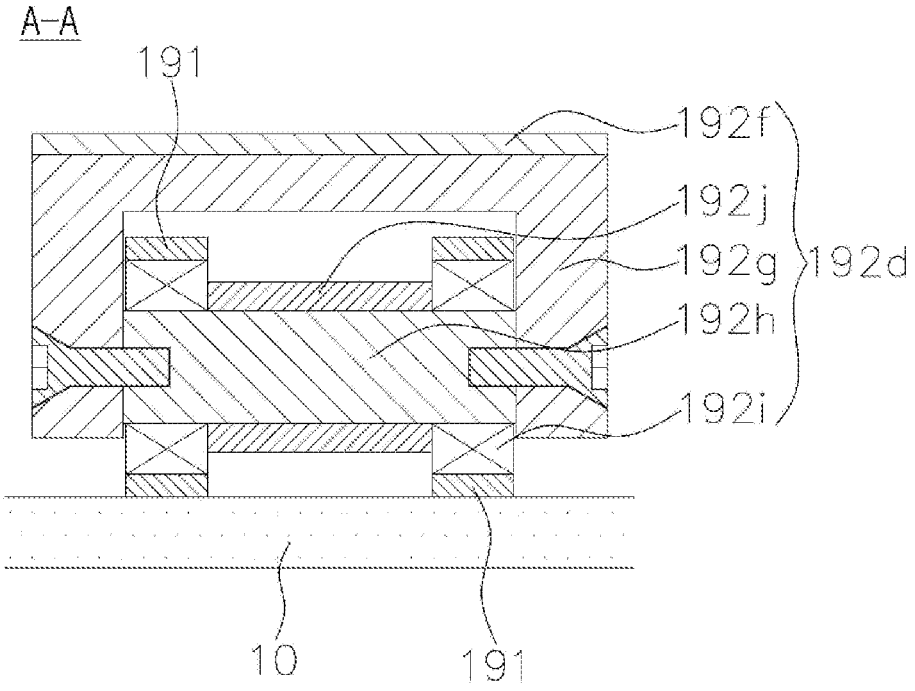
FIG. 8 is a cross-sectional view taken along line A-A in FIG. 6.
Figure 9:
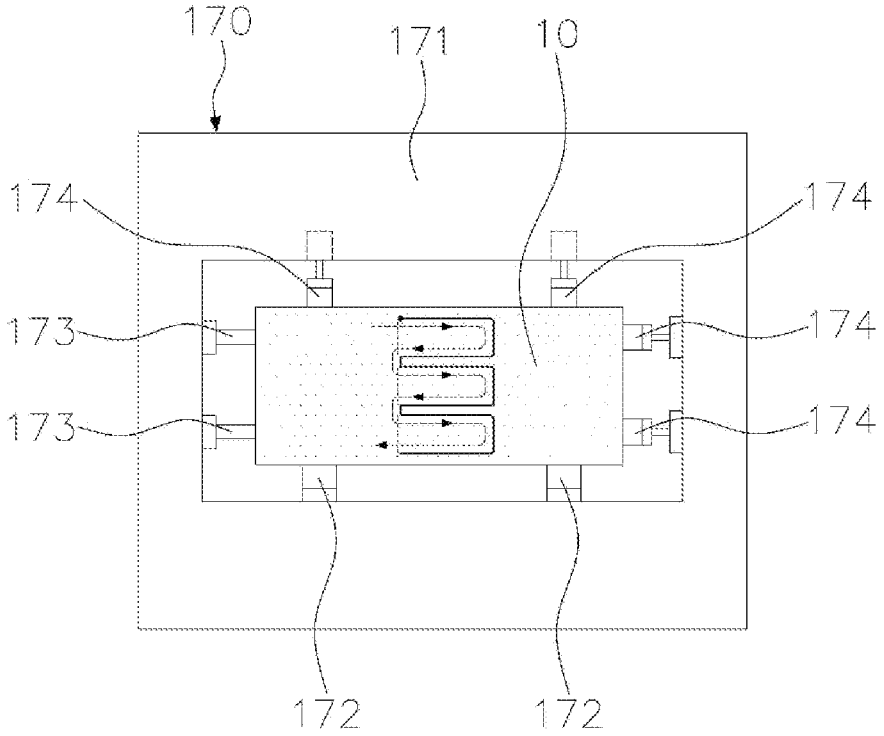
FIG. 9 is a plan view illustrating an early stage of the cutting of the product subsequent to FIG. 3.
Figure 10:
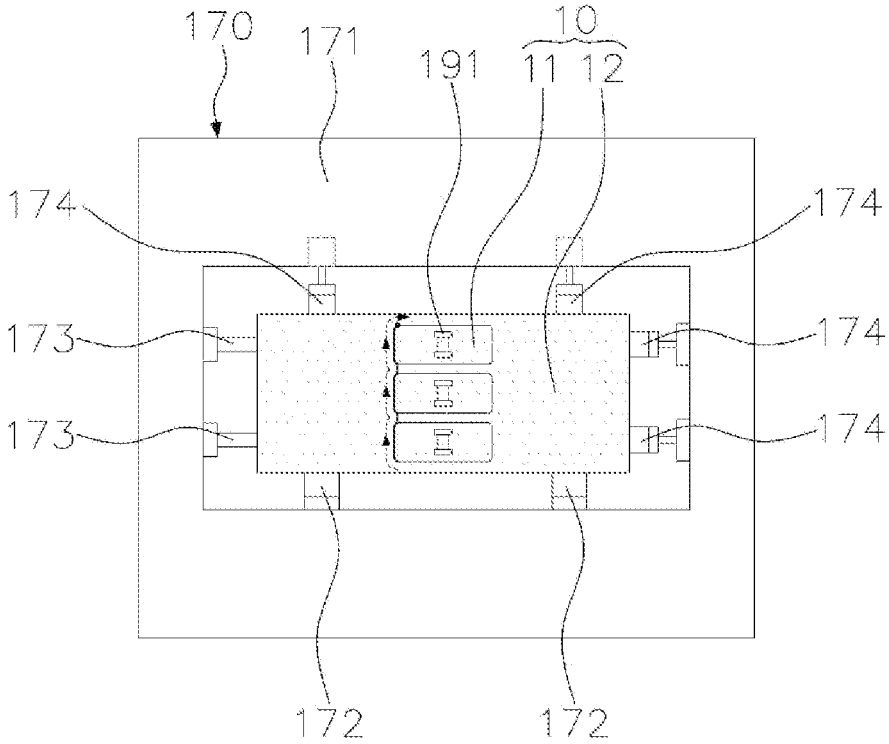
FIG. 10 is a plan view illustrating a final stage of the cutting of the product subsequent to FIG. 9.
Figure 11:
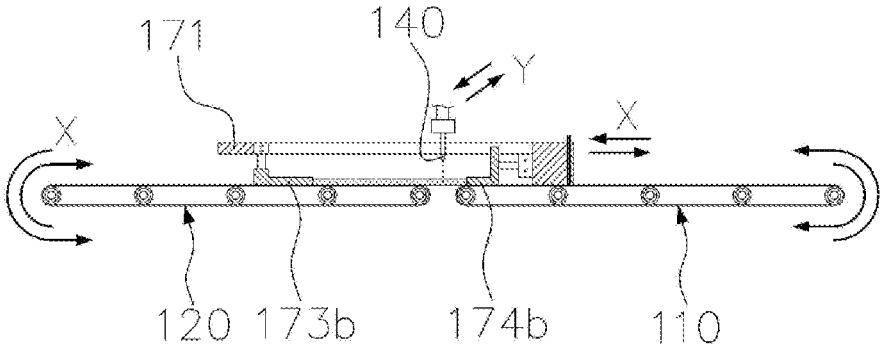
FIG. 11 is a view corresponding to FIG. 1, illustrating a state corresponding to the state of FIG. 9.
Figure 12:
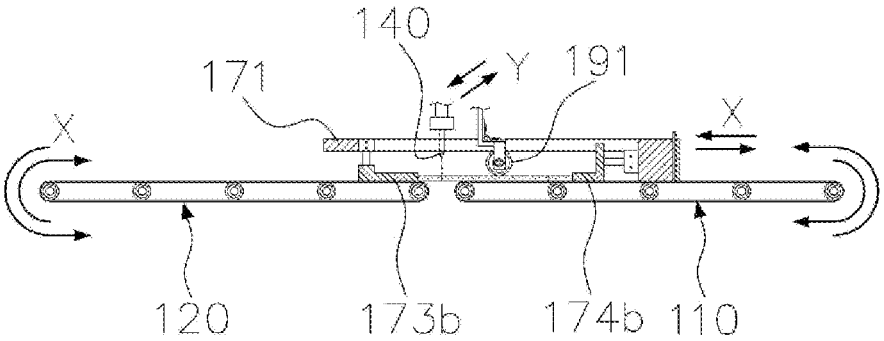
FIG. 12 is a view corresponding to FIG. 1, illustrating a state corresponding to the state of FIG. 10.

FIG. 1 is a conceptual view illustrating a water jet cutting apparatus according to an embodiment of the present invention; FIG. 2 is a plan view of the workpiece edge clamping device illustrated in FIG. 1 and conceptual side views of portions of the workpiece edge clamping device; FIG. 3 is a plan view of the workpiece edge clamping device illustrated in FIG. 2, in which a workpiece is loaded; FIG. 4 is an enlarged view of the workpiece edge clamping device and the carry-in belt-type conveyor unit illustrated in FIG. 1; FIG. 5 is a perspective view of the product fixing pushers and the pusher frame illustrated in FIG. 1; FIG. 6 and FIG. 7 are conceptual side views of operating states of the pusher frame illustrated in FIG. 5; FIG. 8 is a cross-sectional view taken along line A-A in FIG. 6; FIG. 9 is a plan view illustrating an early stage of the cutting of the product subsequent to FIG. 3; FIG. 10 is a plan view illustrating a final stage of the cutting of the product subsequent to FIG. 9; FIG. 11 is a view corresponding to FIG. 1, illustrating a state corresponding to the state of FIG. 9; and FIG. 12 is a view corresponding to FIG. 1, illustrating a state corresponding to the state of FIG. 10.

FIG. 2 illustrates the workpiece edge clamping device in a plan view, and illustrates the shapes and operating concepts of the respective clamping members in enlarged conceptual side views.

First, a basic structure of the water jet cutting apparatus according to an embodiment of the present invention will be described with reference to FIG. 1.

A carry-in belt-type conveyor unit 110 and a carry-out belt-type conveyor unit 120 are provided on a base frame (not shown).

The carry-in belt-type conveyor unit 110 is configured to transport a plate-shaped workpiece 10 loaded thereon reciprocally in an X direction. The carry-out belt-type conveyor unit 120 is also configured to transport the workpiece 10 loaded thereon reciprocally in the X direction.

Although the workpiece 10 according to the present embodiment may be a glass plate, the material and shape of the workpiece 10 may be changed variously.

The carry-in belt-type conveyor unit 110 and the carry-out belt-type conveyor unit 120 each have a plurality of rollers around which a belt is wound.

Providing the carry-in belt-type conveyor unit 110 and the carry-out belt-type conveyor unit 120 respectively using rollers and a belt is a very common technology, and thus a detailed description thereof will be omitted.

The carry-out belt-type conveyor unit 120 is disposed adjacent to and spaced apart from the rear end of the carry-in belt-type conveyor unit 110 with a processing interval 130.

The processing interval 130 extends in a Y direction perpendicular to the X direction, i.e. a direction in which the carry-in belt-type conveyor unit 110 transports the workpiece 10.

An ejection nozzle 140 is disposed above the processing interval 130.

The ejection nozzle 140 is configured to eject fluid in a high pressure to cut the workpiece 10. The pressurized fluid may be water or a mixture of water and abrasive.

The ejection nozzle 140 cuts the workpiece 10 while moving in the Y direction perpendicular to the X direction, i.e. in the extension direction of the processing interval 130.

A nozzle driving unit (not shown) is provided to move the ejection nozzle 140.

The nozzle driving unit may drive the ejection nozzle 140 so that the ejection nozzle 140 is reciprocally moved in the Y direction. In addition, the nozzle driving unit may drive the ejection nozzle 140 so that the ejection nozzle 140 is moved reciprocally in the top-bottom direction.

Although the nozzle driving unit is generally provided in a gantry type in the base frame, in some cases, the nozzle driving unit may be implemented by a robot or the like.

A catcher 150 is provided below the ejection nozzle 140, i.e. below the processing interval 130.

The catcher 150 is configured to receive the pressurized fluid ejected from the ejection nozzle 140, and is typically provided in the shape of a tank. In some cases, the catcher 150 may be configured to reciprocally move together with the ejection nozzle 140 in the Y direction.

The structures of the carry-in belt-type conveyor unit 110, the carry-out belt-type conveyor unit 120, the ejection nozzle 140, the nozzle driving unit, and the catcher 150 as described above can be applied in a wide variety of ways.

The carry-out belt-type conveyor unit 120 includes a plurality of rollers and a carry-out belt 122 wound on the rollers. Among the rollers, one roller located on one end is a driving roller 121 to move the carry-out belt 122, and the remaining rollers are guide rollers. That is, the carry-out belt 122 moves along the driving roller 121 in response to the rotation of the driving roller 121, and the guide rollers guide the movement of the carry-out belt 122.

A carry-out driving unit 160 is provided to operate the above-described carry-out belt-type conveyor unit 120.

According to the present embodiment, the carry-out driving unit 160 includes a carry-out driving motor 161 provided on the base frame, a driven pulley 162 mounted on the driving roller 121 of the carry-out belt-type conveyor unit 120, and a timing belt 163 transferring rotational force of the carry-out driving motor 161 to the driven pulley 162.

Thus, when the carry-out driving motor 161 rotates, the rotational force thereof is transferred to the driven pulley 162 via the timing belt 163. As the driving roller 121 rotates together with the driven pulley 162, the carry-out belt 122 of the carry-out belt-type conveyor unit 120 moves in a transverse direction.

In addition, the carry-in belt-type conveyor unit 110 includes a plurality of guide rollers and a carry-in belt 112. That is, the carry-in belt-type conveyor unit 110 does not include a separate driving roller.

A workpiece edge clamping device 170 is provided above the carry-in belt-type conveyor unit 110.

The workpiece edge clamping device 170 includes a rectangular frame 171 and a plurality of clamping members.

As illustrated in FIGS. 2 and 4, the rectangular frame 171 has a workpiece input space 171*a* in the central portion of the interior thereof, the workpiece input space 171*a* being open in the top-bottom direction.

The workpiece input space 171*a* also has a rectangular shape in a plan view.

As illustrated in the enlarged view of FIG. 4, the carry-in belt 112 is coupled to an outer edge of the rectangular frame 171. That is, the carry-in belt 112 not only forms a closed curve surrounding the plurality of guide rollers, and both ends of the carry-in belt 112 are coupled to outer edge of the rectangular frame 171 while being brought together and erected.

That is, as a belt fixing member 113 is bolt-coupled to an outer edge of the rectangular frame 171, the carry-in belt 112 is fixed with both ends thereof being fitted between the belt fixing member 113 and the rectangular frame 171.

According to this structure, the carry-in belt-type conveyor unit 110 may move synchronously with the workpiece edge clamping device 170.

In the rectangular frame 171, the portion to which the belt fixing member 113 is coupled (the right portion in FIG. 4) is loaded on the carry-in belt 112, but the other portion (such as the left portion in FIG. 4) is spaced apart from the carry-in belt 112.

In addition, the plurality of clamping members provided on the inner edge of the rectangular frame 171 will be described with reference to FIG. 2.

The plurality of clamping members is provided on the inner edge of the rectangular frame 171 to clamp the edge of the workpiece 10 introduced into the workpiece input space 171*a*.

The clamping members used in the present embodiment include fixed clamping members 172, vertically movable clamping members 173, and horizontally movable clamping members 174.

The fixed clamping members 172 may be (or include) L-shaped fixed clamping brackets 172 provided on the inner portions of the rectangular frame 171. The fixed clamping brackets 172 do not move in the top-bottom direction or the transverse direction and clamp the workpiece 10 by supporting the edge of the workpiece 10.

Each of the vertically movable clamping members 173 includes a vertically driving cylinder 173*a* coupled to the rectangular frame 171 and an L-shaped vertically movable clamping bracket 173*b* coupled to the vertically driving cylinder 173*a* to be vertically movable by the vertically driving cylinder 173*a*.

According to the present embodiment, the vertically movable clamping members 173 are provided as two clamping members, and are provided inside the rectangular frame 171 adjacent to the carry-out belt-type conveyor unit 120.

When the vertically movable clamping bracket 173*b* is moved downwards by the vertically driving cylinder 173*a*, the vertically movable clamping bracket 173*b* may clamp the workpiece 10 by supporting the edge of the workpiece 10.

Figure 13:
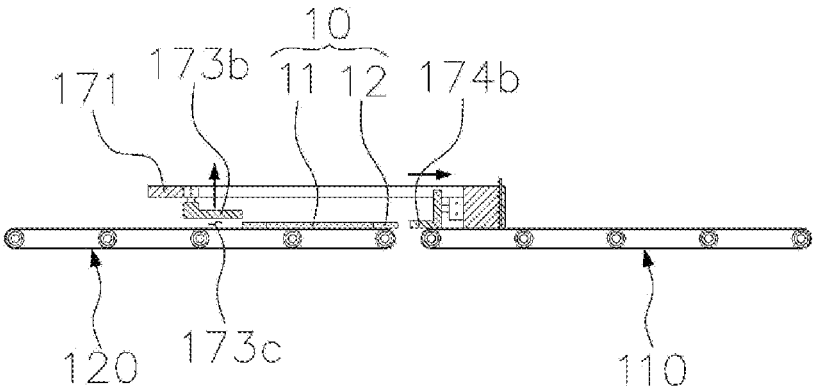
FIG. 13 is a view corresponding to FIG. 1, illustrating the operation of the vertically movable clamping member.
Figure 14:
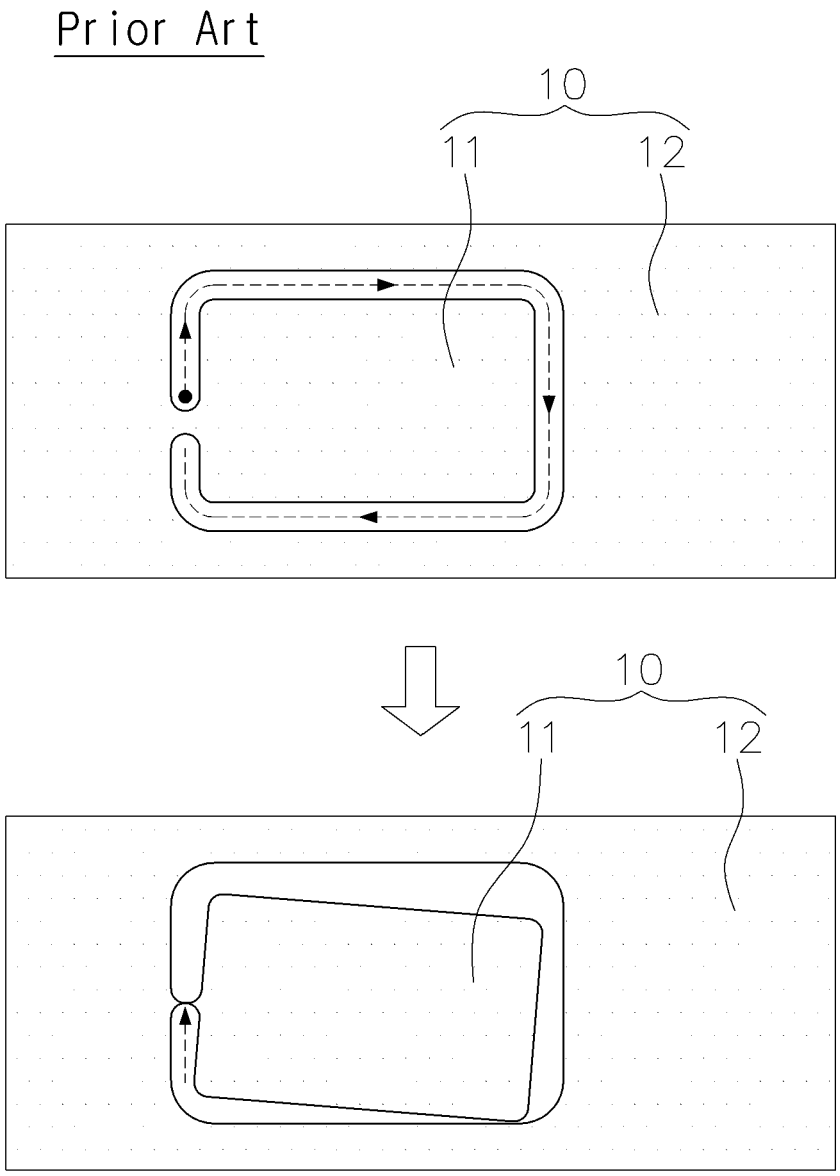
FIG. 14 is a plan view illustrating a cutting state of a workpiece in order to describe problems of the related art.

When the vertically movable clamping bracket 173*b* is moved upwards by the vertically driving cylinder 173*a*, a discharge space 173*c*, through which the workpiece 10 can be discharged from the rectangular frame 171, may be formed between the vertically movable clamping bracket 173*b* of the vertically movable clamping member 173 and the carry-out belt 122 of the carry-out belt-type conveyor unit 120 (see FIG. 13).

Each of the horizontally movable clamping members 174 includes a horizontally driving cylinder 174*a* coupled to the rectangular frame 171 and an L-shaped horizontally movable clamping bracket 174*b* coupled to the horizontally driving cylinder 174*a* to be horizontally movable by the horizontally driving cylinder 174*a*.

Thus, in the state of FIG. 2, when the workpiece 10 is introduced into the workpiece input space 171*a* of the rectangular frame 171 and the horizontally movable clamping brackets 174*b* of the horizontally movable clamping members 174 are moved toward the workpiece 10, the edge of the workpiece 10 is clamped by the two fixed clamping members 172, the four horizontally movable clamping members 174, and the two vertically movable clamping members 173 as illustrated in FIG. 3.

In some embodiments, the number and arrangement of the fixed clamping members 172, the horizontally movable clamping members 174, and the vertically movable clamping members 173 may be changed variously.

A clamping device driving unit 180 for driving the above-described workpiece edge clamping device 170 will be described hereinafter.

The clamping device driving unit 180 drives the workpiece edge clamping device 170 so that the workpiece edge clamping device 170 reciprocally moves in the X direction.

The clamping device driving unit 180 includes a screw 181 extending in the X direction to be rotatably supported on the base frame, a screw driving motor 182 driving the screw 181 to rotate, and a nut 183 provided on the rectangular frame 171 to be connected to the screw 181 by ball screw coupling.

That is, when the screw driving motor 182 rotates the screw 181, the rotation of the screw 181 is converted into a linear movement of the rectangular frame 171 by the nut 183 connected to the screw 181 by ball screw coupling.

In addition, when the rectangular frame 171 is reciprocally moved in the X direction by the screw driving motor 182, the carry-in belt 112 of the carry-in belt-type conveyor unit 110 reciprocally moves in the X direction in concert with the movement of the rectangular frame 171.

In this manner, the carry-in belt-type conveyor unit 110 moves synchronously with the workpiece edge clamping device 170.

Since the workpiece 10 may be precisely reciprocally moved in the X direction by the screw driving motor 182 as described above, the precision of processing of the water jet cutting apparatus may be significantly improved.

The water jet cutting apparatus includes product fixing pushers 191 to fix the product 11 converted from the workpiece 10.

The present embodiment is intended to obtain three products 11 (indicated with dotted lines in FIG. 3 since they have not been cut yet) having a smaller area than the workpiece 10 by water jet cutting.

Thus, the workpiece 10 may be divided into the three products 11 and a remaining portion 12 surrounding the products 11, as illustrated in FIG. 10, by the water jet cutting.

The product fixing pushers 191 are configured to fix the workpiece 10 (including the products 11) by pressing the top surfaces of the portions of the workpiece 10 to be converted into the products 11. That is, the product fixing pushers 191 are not related to the portions of the workpiece 10 to be converted into the remaining portion 12.

As illustrated in FIG. 5, according to the present embodiment, the product fixing pushers 191 are configured to rotate in concert with the movement of the workpiece 10 by contact with the workpiece 10 moving in the X direction.

In some cases, the product fixing pushers 191 may have the shape of balls.

Since the product fixing pushers 191 are rotatable in concert with the movement of the workpiece 10 as described above, the product fixing pushers 191 may reliably press and fix the workpiece 10 while rotating in concert with the reciprocal movement of the workpiece 10 during the reciprocal movement of the workpiece 10 in the X direction, thereby preventing the product 11 from being displaced.

In addition, in some embodiments, the product fixing pushers may be configured to be irrotational. In a case in which the product fixing pushers having this configuration are used, the workpiece 10 must not be reciprocally moved in the X direction while the workpiece 10 is fixed by the product fixing pushers.

The product fixing pushers 191 as described above are coupled to a pusher frame 192 to be rotatably supported thereby.

In addition, a pusher driving unit (not shown) driving the pusher frame 192 to move reciprocally in the top-bottom direction is provided.

Since the pusher driving unit (not shown) is intended to realize reciprocal movement in the top-bottom direction, a wide variety of technological solutions may be adopted for the pusher driving unit (not shown).

The pusher driving unit (not shown) moves the pusher frame 192 upwards in an early stage of the cutting of the product 11 so that the product fixing pushers 191 moves away from the workpiece 10, and moves the pusher frame 192 downwards in a final stage of the cutting of the product 11 so that the product fixing pushers 191 press and fix the workpiece 10.

That is, the product fixing pushers 191 is moved downwards only in the final stage of the cutting of the product 11, thereby coming into contact with the portions of the workpiece 10 to be converted into the product 11.

A specific shape of the pusher frame 192 will be described with reference to FIGS. 5 to 7.

According to the present embodiment, the pusher frame 192 includes a single head frame 192*a* and a plurality of branch frames 192*b* (three branch frames 192*b* in the present embodiment), as illustrated in FIG. 5.

The head frame 192*a* is a portion of the pusher frame 192 to be coupled to the pusher driving unit (not shown).

The branch frames 192*b* are provided between the head frame 192*a* and the product fixing pushers 191. The branch frames 192*b* rotatably support the product fixing pushers 191.

Thus, the product fixing pushers 191 are provided on the branch frames 192*b*.

In addition, the branch frames 192*b* are configured to be spaced apart from each other in the Y direction.

This structure of the pusher frame 192 comprised of the single head frame 192*a* and the plurality of branch frames 192*b* means that the product fixing pushers 191 do not move in the Y direction.

A specific structure of the branch frames 192*b* will be described.

Each of the branch frames 192*b* according to the present embodiment includes a connecting frame 192*c*, an elastic member 192*e*, an elastic support frame 192*d*, and a hinge member 192*f*.

The connecting frame 192*c* is a portion connected to the head frame 192*a* to be moved in the top-bottom direction by the pusher driving unit.

The connecting frame 192*c* according to the present embodiment has an L-shaped cross-sectional structure.

The elastic support frame 192*d* is coupled to the connecting frame 192*c* via the hinge member 192*f*.

One portion of the hinge member 192*f* is coupled to the connecting frame 192*c* while the other portion of the hinge member 192*f* is coupled to the elastic support frame 192*d*.

In addition, the elastic member 192*e* having the shape of a torsion spring is provided on the hinge member 192*f*.

Due to the L-shaped structure of the connecting frame 192*c*, the maximum angle of the hinge member 192*f* is 90°, as illustrated in FIG. 6. The elastic support frame 192*d* may be moved upwards together with the elastic member 192*e* and the hinge member 192*f* (i.e. the angle of the hinge member 192*f* is reduced to be smaller than 90°) depending on the degree of flatness of the workpiece 10, as illustrated in FIG. 7. Due to this structure, the branch frames 192*b* are easily adaptable to uneven surface of the workpiece 10. After having passed the uneven portion of the workpiece 10, the elastic support frame 192*d* may be returned to the position illustrated in FIG. 6, by the restoring force of the elastic member 192*e*.

As described above the elastic support frame 192*d* is movable in the top-bottom direction while being elastically supported by the elastic member 192*e* depending on the degree of flatness of the workpiece 10.

According to the present embodiment, the elastic support frame 192*d* is movable in the top-bottom direction while being elastically supported by the hinge member 192*f* and the torsion spring-shaped elastic member 192*e*. In some embodiments, the elastic support frame may be provided on the connecting frame to be slidable in the top-bottom direction, and the elastic member having the shape of a compression spring may elastically support the elastic support frame 192*d* downwards.

A specific structure of the elastic support frame 192*d* is illustrated in FIG. 8.

The elastic support frame 192*d* includes an inverted U-shaped roller housing 192*g* coupled to the hinge member 192*f*, a roller support rod 192*h* mounted on the roller housing 192*g*, a pair of bearings 192*i* mounted on the roller support rod 192*h*, and a spacer 192*j* provided between the bearings of the pair of bearings 192*i*.

The roller-shaped product fixing pushers 191 are mounted on the bearings 192*i*, respectively. The product fixing pushers 191 may be fabricated from elastic rubber having a predetermined level of elasticity.

In some embodiments, the product fixing pushers 191 made of elastic rubber may not be mounted on the bearings 192*i*. In this case, the bearings 192*i* may be regarded as serving as the product fixing pushers.

According to this structure, two product fixing pushers 191 are mounted on a single elastic support frame 192*d*. In addition, a single product 12 may be fixed by two product fixing pushers 191 (see FIG. 10).

The operation of the present embodiment will be described hereinafter.

The workpiece 10 is introduced into the workpiece edge clamping device 170. Afterwards, the horizontally movable clamping brackets 174*b* of the horizontally movable clamping members 174 of the workpiece edge clamping device 170 are moved to clamp the workpiece 10, as illustrated in FIG. 3. After the workpiece 10 is clamped, the water jet cutting is performed.

FIG. 9 is a conceptual plan view illustrating the water jet cutting performed in an early stage of processing (i.e. water jet cutting), and FIG. 11 is a conceptual side view of FIG. 9.

In a state in which the workpiece 10 is clamped by the workpiece edge clamping device 170, the clamping device driving unit 180 is operated to drive the workpiece edge clamping device 170 and the carry-in belt-type conveyor unit 110 to move reciprocally in the X direction. In response to the operation of the carry-out driving unit 160, the carry-out belt-type conveyor unit 120 moves reciprocally in the X direction while moving the workpiece 10 reciprocally in the X direction. In addition, after the ejection nozzle 140 has been moved downwards by the nozzle driving unit, the ejection nozzle 140 performs the water jet cutting while moving reciprocally in the Y direction.

Since the workpiece 10 may be carried precisely and reciprocally in the X direction by the screw driving motor 182, the degree of processing precision may be significantly improved.

In addition, the pusher frames 192 and the product fixing pushers 191 remain spaced apart from the workpiece 10. The portions of the workpiece to be converted into products are not pressed by the product fixing pushers 191.

If the portions of the workpiece to be converted into products are fixed by the product fixing pushers 191 in FIG. 9, there will be a danger that the product fixing pushers 191 may collide against edges of the cut portions of the workpiece 10 in response to the reciprocal movement of the workpiece 10 in the X direction, thereby damaging the product fixing pushers 191 and the products. Accordingly, in the early stage of the cutting, the portions of the workpiece to be converted into products must not be pressed by the product fixing pushers 191.

FIG. 10 is a conceptual plan view illustrating the water jet cutting performed in a final stage of the cutting process, and FIG. 12 is a conceptual side view of FIG. 10.

The water jet cutting is performed by moving the workpiece 10 reciprocally in the X direction and moving the ejection nozzle 140 reciprocally in the Y direction using the nozzle driving unit. This is the same as in the case of FIG. 9.

In FIGS. 10 and 12, the pusher frames 192 and the product fixing pushers 191 are moved downwards by the pusher driving unit (not shown), so that the product fixing pushers 191 press and fix the portions of the workpiece to be converted into products.

Accordingly, the position of the product 11 is not changed even at the moment that the cutting process of the product 11 is completed, and thus, precise processing is possible.

As described above, the present invention ensures that the portions of the workpiece to be converted into products are not fixed by the product fixing pushers 191 in the early stage of the cutting and are fixed by the product fixing pushers 191 only in the final stage of the cutting.

When the cutting of the product 11 is completed as described above, the workpiece 10 is divided into the products 11 and the remaining portion 12 surrounding the products 11.

In addition, the water jet cutting is completed, the ejection nozzle 140 is moved upwards by the nozzle driving unit, and the pusher frames 192 and the product fixing pushers 191 are moved upwards by the pusher driving unit (not shown) so as to not be interfered by the movement of the rectangular frame 171.

FIG. 13 illustrates a state in which the workpiece 10 is unclamped.

The vertically movable clamping brackets 173*b* are moved upwards in response to the operation of the vertically driving cylinders 173*a* of the vertically movable clamping members 173, and the clamping brackets 174*b* are moved in a direction away from the workpiece 10 in response to the operation of the horizontally driving cylinders 174*a* of the horizontally movable clamping members 174, so that the workpiece 10 is unclamped.

In addition, the vertically movable clamping bracket 173*b* is moved upwards, thereby forming the discharge space 173*c* between the vertically movable clamping bracket 173*b* and the carry-out belt 122, the discharge space 173*c* allowing the workpiece 10 to escape the rectangular frame 171 therethrough.

Afterwards, the workpiece edge clamping device 170 is easily detached from the workpiece 10, and preparation for the cutting of another workpiece 10 is performed.

Although a preferred embodiment of the present invention has been described for illustrative purposes, those skilled in the art will appreciate that various modifications, additions and substitutions are possible, without departing from the scope and spirit of the invention as disclosed in the accompanying claims. Therefore, the embodiments described above are to be understood in all respects as illustrative and not restrictive. For example, each component described as a single type may be implemented in a distributed manner, and similarly, components described as distributed may be implemented in a combined form.

The scope of the present invention is defined by the following claims rather than the above description, and all changes or modifications derived from the meaning and scope of the claims and their equivalents should be construed as being included in the scope of the present invention.

What is claimed is:

1. A line catcher type water jet cutting apparatus for cutting a workpiece to divide the workpiece into a product and a remaining portion surrounding the product, comprising:

a carry-in belt-type conveyor unit configured to transport the workpiece loaded thereon reciprocally in an X direction;

a carry-out belt-type conveyor unit configured to transport the workpiece loaded thereon reciprocally in the X direction, and disposed adjacent to and spaced apart from a rear end of the carry-in belt-type conveyor unit with a processing interval extending in a Y-direction;

an ejection nozzle disposed above the processing interval to eject a pressurized fluid to cut the workpiece;

a nozzle driving unit driving the ejection nozzle to move reciprocally in a Y direction;

a catcher provided below the ejection nozzle to receive the pressurized fluid ejected from the ejection nozzle;

a product fixing pusher fixing the workpiece by pressing a top surface of a portion of the workpiece to be converted into the product;

a pusher frame to which the product fixing pusher is coupled;

and a pusher driving unit driving the pusher frame to move in a top-bottom direction, wherein the pusher driving unit is configured to move the pusher frame upwards, while the ejection nozzle cuts the workpiece along a cutting curve, except at a final stage of the cutting of the workpiece such that the product fixing pusher is spaced apart from the workpiece and the portion of the workpiece to be converted into the product is not pressed by the product fixing pusher during the cutting of the workpiece except at the final stage of the cutting of the workpiece;

wherein the pusher driving unit is configured to move the pusher frame downward at the final stage of cutting of the workpiece, which includes a moment that the cutting curve for the product is completed in the workpiece by the ejection nozzle, such that the product fixing pusher presses and fixes the top surface of the portion of the workpiece to be converted into the product to maintain a position of the product when a start point of the cutting curve meets an end point of the cutting curve to form a closed cutting curve.

2. The apparatus according to claim 1, wherein the product fixing pusher comprises a plurality of product fixing pushers, and the pusher frame includes a single head frame coupled to the pusher driving unit and a plurality of branch frames provided between the head frame and the product fixing pushers, the branch frames being spaced apart from each other in the Y direction.

3. The apparatus according to claim 1, wherein the product fixing pusher comprises a ball or a roller coming into contact with the workpiece moving in the X direction to rotate in concert with the movement of the workpiece, and the pusher frame rotatably supports the product fixing pusher.

4. The apparatus according to claim 1, wherein the pusher frame includes a connecting frame movable in the top-bottom direction by the pusher driving unit and an elastic support frame coupled to the connecting frame via an elastic member to rotatably support the product fixing pusher, the elastic support frame being movable in the top-bottom direction while elastically supported by the elastic member depending on degrees of flatness of the workpiece.

5. The apparatus according to claim 1, further comprising a workpiece edge clamping device to clamp edges of the workpiece to be converted into the remaining portion while being moved reciprocally in the X direction in concert with the carry-in belt-type conveyor unit.

* * * * *